US006368087B2

(12) United States Patent
Kikuchi et al.

(10) Patent No.: US 6,368,087 B2
(45) Date of Patent: Apr. 9, 2002

(54) SCROLL-TYPE FLUID DISPLACEMENT APPARATUS HAVING SPIRAL START PORTION WITH THICK BASE AND THIN TIP

(75) Inventors: Toshiyuki Kikuchi, Isesaki; Ko Tsukamoto, Isasaki, both of (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 09/777,868

(22) Filed: Feb. 7, 2001

(30) Foreign Application Priority Data

Feb. 10, 2000 (JP) ..... P12-033853

(51) Int. Cl.[7] ..... F01C 1/04
(52) U.S. Cl. ..... 418/55.2; 418/150
(58) Field of Search ..... 418/150, 55.2

(56) References Cited

U.S. PATENT DOCUMENTS

| | | | | |
|---|---|---|---|---|
| 4,457,674 A | | 7/1984 | Kawano et al. | |
| 4,457,676 A | * | 7/1984 | Hiraga | 418/55.5 |
| 4,477,238 A | | 10/1984 | Terauchi | |
| 4,499,099 A | | 2/1985 | Terauchi et al. | |
| 4,547,137 A | | 10/1985 | Terauchi et al. | |
| 4,548,555 A | | 10/1985 | Hiraga et al. | |
| 4,594,061 A | * | 6/1986 | Terauchi | 418/55.2 |
| 4,627,800 A | | 12/1986 | Matsudaira et al. | |
| 4,666,380 A | * | 5/1987 | Hirano et al. | 418/150 |
| 4,824,345 A | | 4/1989 | Fukuhara et al. | |
| 5,037,279 A | | 8/1991 | Suefuji et al. | |
| 5,370,512 A | | 12/1994 | Fujitani et al. | |
| 6,132,179 A | | 10/2000 | Higashiyama | |

FOREIGN PATENT DOCUMENTS

| | | | | |
|---|---|---|---|---|
| EP | 0761971 | | 3/1997 | |
| GB | 2161218 | | 1/1986 | |
| JP | 59079090 | | 8/1984 | |
| JP | 62-107283 | * | 5/1987 | 418/150 |
| JP | 01-130083 | * | 5/1989 | 418/55.2 |
| JP | 04350378 | | 4/1992 | |

* cited by examiner

*Primary Examiner*—Thomas Denion
*Assistant Examiner*—Theresa Trieu

(57) ABSTRACT

A scroll-type compressor includes a fixed and an orbiting scroll each having an end plate and a spiral element on the end plate and interfits with each other. A first transition line at a widened-starting portion of the spiral element between an interior wall and a tip surface comprises a first upper arc connecting to an upper, interior involute wall starting point and a second upper arc connecting to an upper, exterior involute wall starting point and a straight line. A second transition line at the widened-starting portion between the interior wall and a base surface comprises a first lower arc connecting to a lower, interior involute wall starting point and a second lower arc connecting a lower, exterior involute wall starting point and a straight line.

2 Claims, 7 Drawing Sheets

SCROLL-TYPE FLUID DISPLACEMENT APPARATUS HAVING SPIRAL START PORTION WITH THICK BASE AND THIN TIP

BACKGROUND OF THE INVENTION

1. Field of the Invention

The present invention relates to a scroll-type fluid displacement apparatus, and more particularly, to a spiral starting portion of a fixed scroll and an orbiting scroll.

2. Description of Related Art

Scroll-type fluid displacement apparatus are known in the art. For example, U.S. Pat. No. 5,037,279, which is incorporated herein by reference, describes spiral portions of a fixed scroll and an orbiting scroll.

Referring to FIGS. 5 to 7*a–d,* an orbiting scroll 50 has an end plate 50*a*; an involute spiral wrap element 50*b*, which extends from a first side of end plate 50*a*; and an annular boss 50*c*, which extends from a second side of end plate 50*a*. An involute spiral wrap element 40*b* of a fixed scroll (not shown) is formed on an end plate of the fixed scroll and is symmetrical to spiral element 50*b* of orbiting scroll 50. Orbiting scroll 50 is supported on a housing by an Oldham coupling mechanism consisting of an Oldham coupling ring and Oldham coupling keys. The Oldham coupling mechanism prevents the rotation of orbiting scroll 50 on its axis and generates an orbital motion with respect to the fixed scroll.

As shown in FIGS. 5 and 6, a widened-starting portion 500*c* of spiral element 50*b* of orbiting scroll 50 has a cross-sectional shape, in which the thickness is greater at the base surface and less at the tip surface (i.e., the thickness decreases or tapers from the base surface to the tip surface). An exterior curve 506, which is a radially exterior curve between a first tip point 501 at the tip and a first widened-starting point 503 at the base surface, is an involute curve. An interior curve 507, which is a radially interior curve between a second tip point 502 at the tip surface and a second widened-starting point 505 at the base surface, also is an involute curve. A spiral base portion between point 503 and point 505 is composed of the curved line, described below. A region between point 503 and a point 504 is defined by a first convex arc 509. A radius r of the convex arc 509 is defined by the following equation:

$$r = \frac{4a^2(\lambda_1^2 + 1) - \varepsilon^2}{4(\varepsilon + 2a\lambda_1)}$$

where:

a is a radius of an involute base circle;

$\lambda_1$ is a widened-starting angle; and $\epsilon$ is an orbit radius.

A region between point 504 and point 505 is defined by a second concave arc 510. A radius R of the concave arc 510 is defined by the following equation:

$$R=r+\epsilon$$

On the other hand, the region between point 501 and point 502 at the tip of spiral element 50*b* is defined by an arc 508, the diameter of which substantially corresponds to a distance between opposed walls of the involute curve of spiral element 50*b*. A curve along the base from point 503 to point 505 and a curve along the tip from point 501 to point 502 are connected through a smooth inclined wall.

Referring to the compression and discharge strokes of the known scroll-type compressor, FIG. 7*a* shows the known compressor in a condition, in which the suction stroke has been completed and the compression stroke has just begun. Thereafter, the strokes proceed in sequence, as shown FIGS. 7*b,* 7*c* and 7*d,* and a compression chamber 60 gradually moves towards the center like a compression chamber 60', as shown in FIG. 7*a*, while its volume decreases. Consequently, compressed gas is discharged through a discharge port 61.

In the known scroll-type fluid displacement apparatus, however, as shown in a central portion of FIG. 7*d*, when compression is completed, fluid remains in a dead volume, which is defined by an inclined wall of spiral element 50*b* of orbiting scroll 50 and an inclined wall of spiral element 40*b* of the fixed scroll. The fluid in this dead volume expands, and interupts the drawing of new fluid into compression chamber 60. As a result, the compression efficiency of the scroll-type fluid displacement apparatus may be reduced.

Further, each of the tip points of spiral element 50*b* of orbiting scroll 50 and of spiral element 40*b* of the fixed scroll has a sharp edge shape. Therefore, when orbiting scroll 50 and the fixed scroll are operated in the compression and discharge strokes, defects may be created in the tip points of each spiral elements because both spiral element engage each other.

SUMMARY OF THE INVENTION

A technical advantage of the present invention is to reduce or eliminate the above-mentioned defects encountered in the spiral elements of the known scroll-type fluid displacement apparatus.

Another technical advantage of the present invention is to provide a scroll-type fluid displacement apparatus, which has increased strength in the central portions of spiral elements of an orbiting scroll and a fixed scroll.

A further technical advantage of the present invention is to provide the scroll-type fluid displacement apparatus, which has increased volmetric efficiency, e.g., compression efficiency, expansion efficiency, and discharge efficiency.

In an embodiment of this invention, a scroll-type fluid displacement apparatus comprises a rear housing and a front housing, a fixed scroll and an orbiting scroll, a driving mechanism, and a rotation preventing mechanism. The rear housing has an open end and an inlet port and an outlet port. A front housing closes the open end of the rear housing. The fixed scroll has a first end plate and a spiral element formed on and extending from a first side of the first end plate. The fixed scroll is attached to the rear housing. The orbiting scroll has a second end plate and a spiral element formed on and extending from a first side of the second end plate. Each of the spiral elements interfits with the other at an angular and a radial offset to form a plurality of line contacts defining at least one pair of sealed-off fluid pockets. A driving mechanism includes a drive shaft rotatably supported by the front housing to effect the orbital motion of the orbiting scroll by rotation of the drive shaft to thereby change the volume of the fluid pockets. A rotation preventing mechanism prevents the orbiting scroll from rotating. An interior wall of a widened-starting portion of each of the spiral elements is inclined, such that the thickness of a base surface of the widened-starting portion is greater than the thickness at a tip surface and the thickness of the widened-starting portion gradually decreases towards the tip surface of the widened-starting portion. A first transition line between the interior wall and the tip surface comprises a first upper arc ending at an upper, interior involute wall starting point and a second upper arc beginning at an upper, exterior involute wall starting point. A second transition line between the interior wall and the base surface comprises a first lower arc ending at the lower, interior involute wall starting point and a second lower small arc beginning at the lower, exterior involute wall starting point.

Other objects, features, and advantages will be apparent to persons of ordinary skill in the art from the following detailed description of the invention and the accompanying drawings.

BRIEF DESCRIPTION OF THE DRAWINGS

The present invention may be more readily understood with reference to the following drawings, in which:

FIG. 2*a* is a plan view and FIG. 2*b* is a perspective view of the spiral element of the orbiting scroll;

DETAILED DESCRIPTION OF PREFERRED EMBODIMENTS

Figure 1:
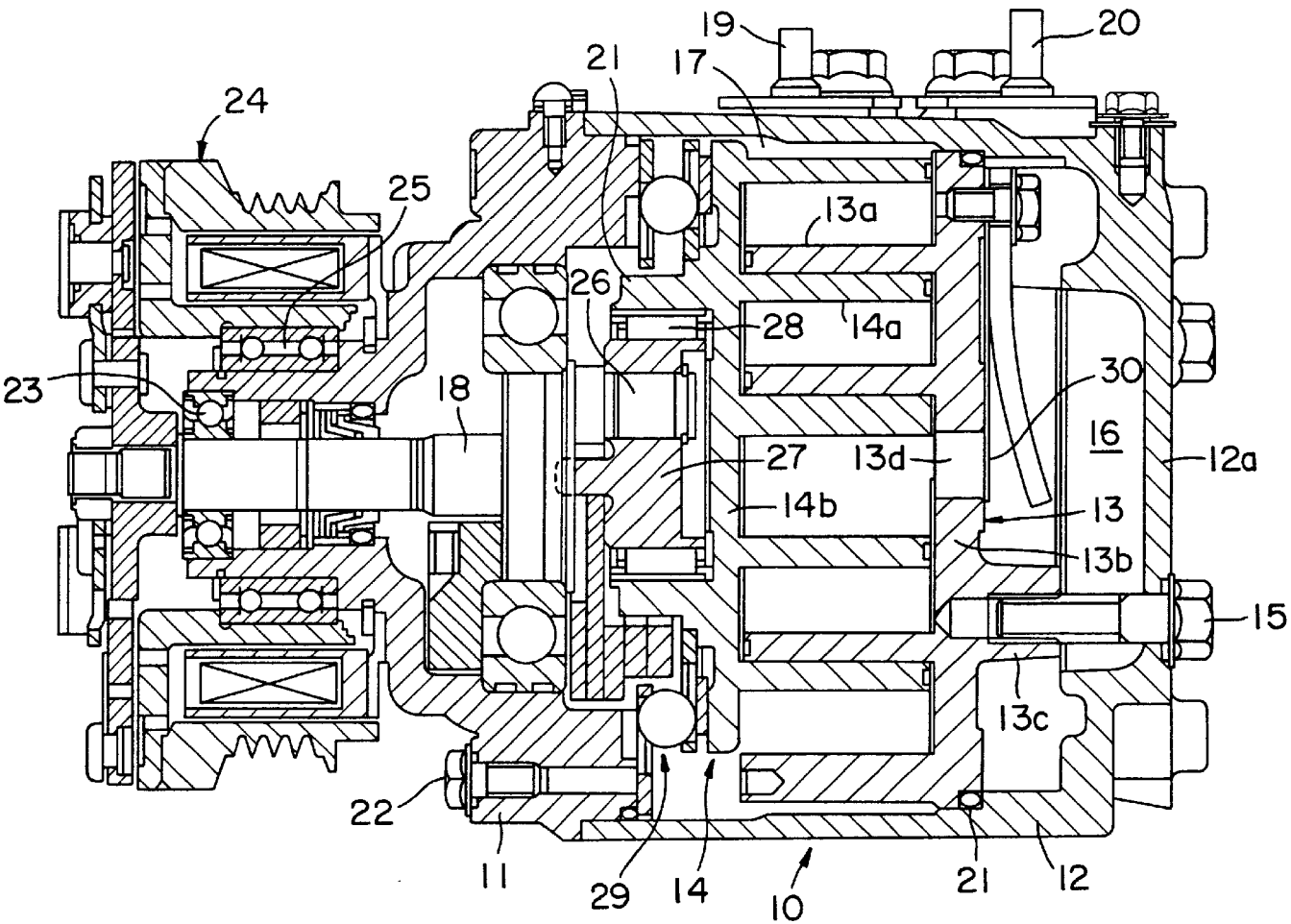
FIG. 1 is a longitudinal, cross-sectional view of a scroll-type fluid displacement apparatus in accordance with an embodiment of the present invention.

Referring to FIG. 1, a scroll-type compressor includes a housing 10, which comprises a front housing 11 and a cup-shaped rear housing 12. Front housing 11 is secured to rear housing 12 by a plurality of bolts 22. A fixed scroll 13 and an orbiting scroll 14 are located within housing 10.

Fixed scroll 13 includes a disk-shaped first end plate 13*b* and a first spiral element 13*a*, which is formed on a first side of first end plate 13*b*, and a foot portion 13*c*, which is formend on a second side of first end plate 13*b*. A discharge port 13*d* is formed at the central portion of first end plate 13*b*. Foot portion 13*c* is fixed securely to an inside wall of a bottom portion 12*a* of rear housing 12 through a plurarity of bolts 15, which penetrate rear housing 12 from the exterior. First end plate 13*b* of fixed scroll 13 is fixed to an inside wall of rear housing 12, and divides the inner chamber of rear housing 12 into a suction chamber 17 and a discharge chamber 16. A seal member 21 seals an exterior circumference of first end plate 13*b* and the inside wall of rear housing 12.

Orbiting scroll 14 includes a disk-shaped second end plate 14*b* and a second spiral element 14*a*, which extends from a first side of second end plate 14*b*, and an annular boss 21, which is formed on and axially projects from a second side of second end plate 14*b*. First spiral element 13*a* of fixed scroll 13 and second spiral element 14*a* of orbiting scroll 14 interfit at an angular offset of about 180 degrees and at a predetermined radial offset. At least a pair of fluid pockets are defined between fixed scroll 13 and orbiting scroll 14.

A drive shaft 18 is disposed in housing 10 and is rotatably supported by front housing 11 through a first radial bearing 23. An electromagnetic clutch 24 is rotatably supported by front housing 11 through a second radial bearing 25 and connects to one end portion of drive shaft 18. A crank pin 26 is connected eccentrically to another end of drive shaft 18. Crank pin 26 is inserted into annular boss 21 of orbiting scroll 14, and is inserted into a disk-shaped eccentric bushing 27. Eccentric bushing 27 is rotatably disposed in the annular boss 21 through a third radial bearing 28.

A rotation preventing mechanism 29 is provided between a surface of orbiting scroll 14 and the end surface of front housing 11. Rotation preventing mechanism 29 prevents the rotation of orbiting scroll 14 with respect to fixed scroll 13, when orbiting scroll 14 moves in an orbital motion at a predetermined orbital radius with respect to the center of fixed scroll 13.

When a driving force is transferred from an external driving source (e.g., an engine of a vehicle) via electromagnetic clutch 24, drive shaft 18 is rotated, and orbiting scroll 14, which is supported by crank pin 26, is driven in an orbital motion by the rotation of drive shaft 18. When orbiting scroll 14 is driven in an orbital motion, fluid pockets, which are defined between first spiral element 13*a* of fixed scroll 13 and second spiral element 14a of orbiting scroll 14, move from the outer or peripheral portions of the spiral elements to the center portion of the spiral elements. Refrigerant gas, which enters a suction chamber 17 through an inlet port 19 formed on rear housing 12, flows into one of the fluid pockets. When the fluid pockets move from the outer portions of the spiral elements to the center portion of the spiral elements, the volume of the fluid pockets is reduced, and refrigerant gas in the fluid pockets is compressed. Compressed refrigerant gas confined within the fluid pockets moves through discharge port 13*d*, displaces reed valve 30, and is discharged into discharge chamber 16. Finally, the compressed refrigerant gas is discharged into an external refrigerant circuit (not shown) through an outlet port 20 formed on rear housing 12.

Figure 2A:
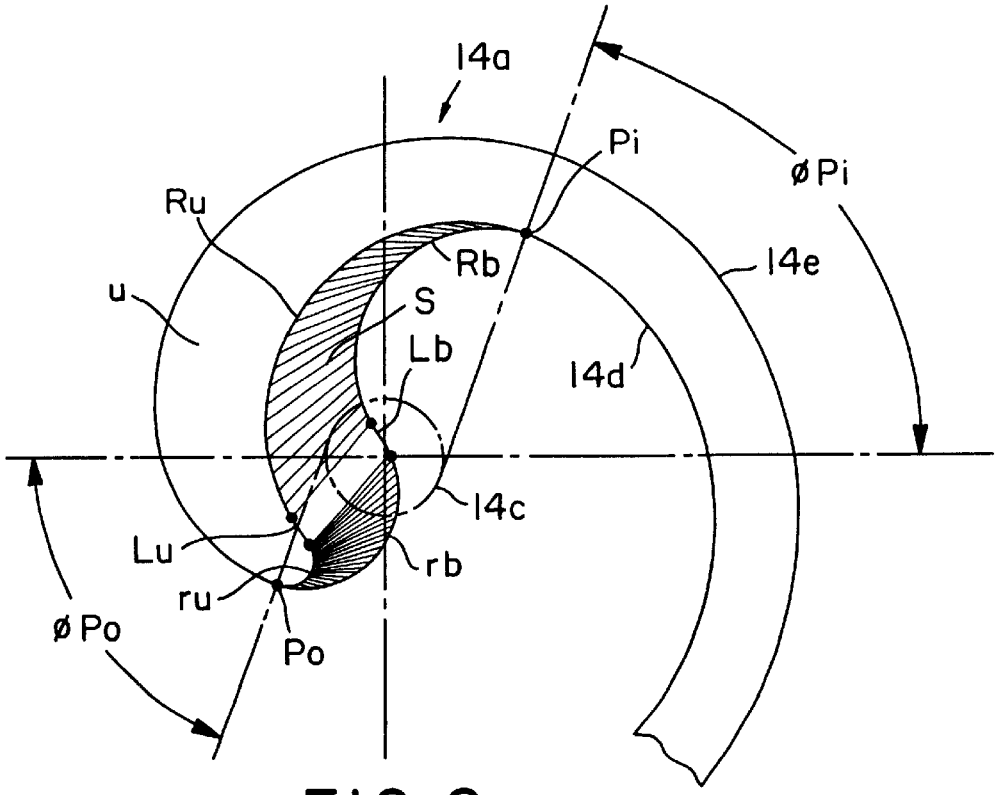
FIGS. 2*a* and 2*b* are enlarged, detailed partial views of a spiral element of an orbiting scroll.
Figure 2B:
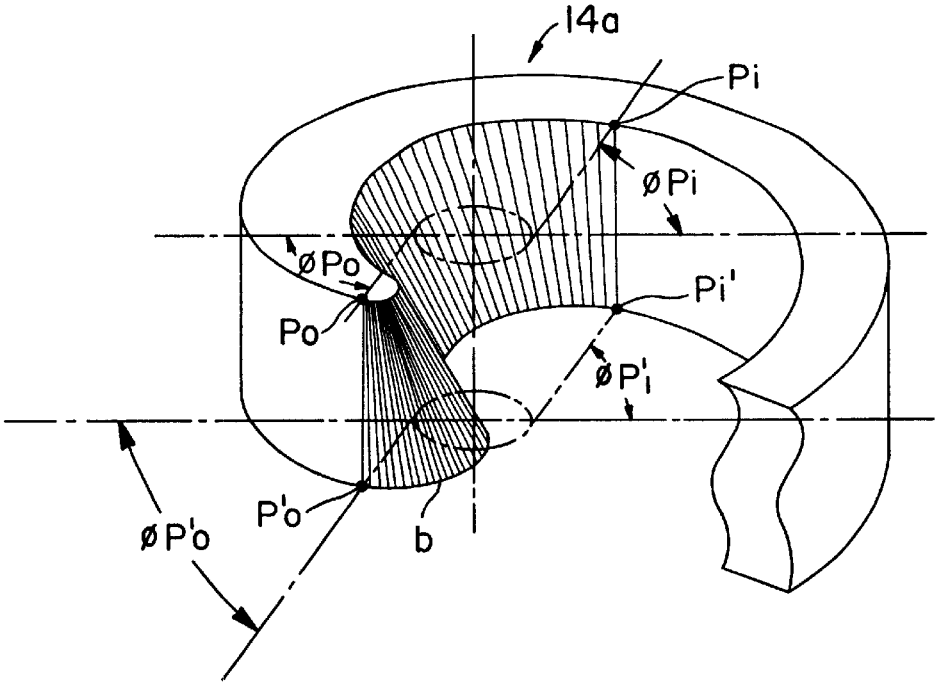
Figure 3:
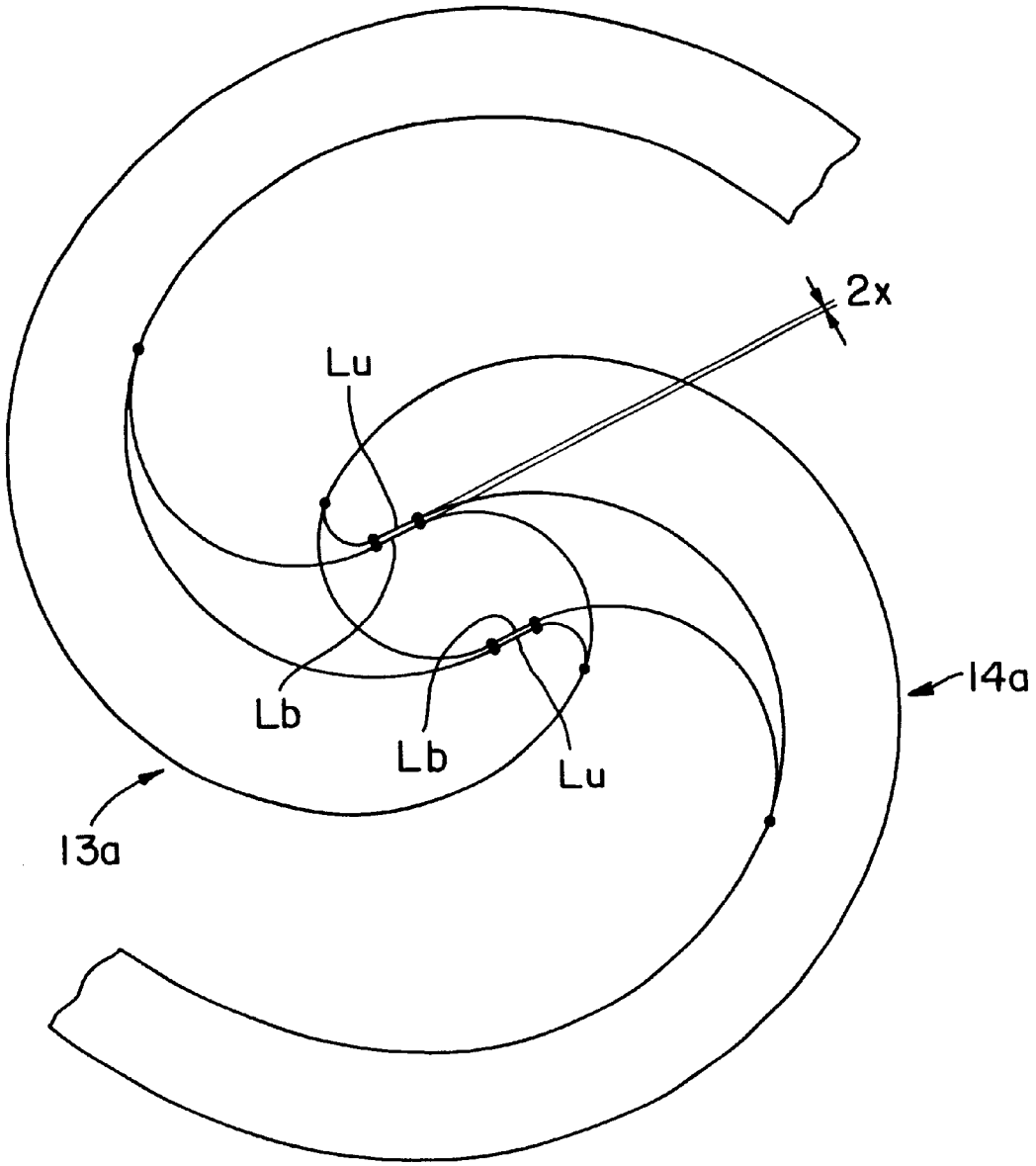
FIG. 3 is a perspective view of spaces between the orbiting scroll and a fixed scroll, each of which exhibits doubled correction values.

A configuration of an orbiting scroll of a scroll-type fluid displacement apparatus in accordance with a first embodiment is shown in FIGS. 2*a–b* and 3. Because the orbiting scroll and the fixed scroll interfit each other, shapes of spiral elements of the orbiting scroll and the fixed scroll are symmetrical.

Referring to FIGS. 2*a* and 2*b*, if circle 14*c* is the basic involute circle, a first transition line between inside wall s and tip surface u formed at center of spiral element 14*a* comprises a first upper arc Ru, a second upper arc ru, and a straight line Lu, which connects first upper arc Ru to second upper arc ru. First upper arc Ru is connected to an interior involute wall 14*d* at upper, interior involute wall starting point Pi. Second upper arc ru is connected to an exterior involute wall 14*e* at upper, exterior involute wall starting point Po. A second transition line between inside wall s and base surface b comprises a first lower arc Rb, a second lower arc rb, and a straight line Lb, which connects first lower arc Rb to second lower arc rb. First lower arc Rb is connected to an interior involute wall 14*d* at lower, interior involute wall starting point Pi'. Second lower arc rb is connected to exterior involute wall 14*e* at lower, exterior involute wall starting point Po'.

Interior wall s is inclined, so that it has a thickness which is greater at base surface b than at tip surface u. The thickness of interior wall s gradually decreases or tapers from base surface b to tip surface u. Therefore, the strength of the wall of spiral element 14*a* may be greater than that of a spiral element in a known scroll-type compressor. The above-mentioned elements, such as first lower arc Rb, first upper arc Ru, and the like, are defined by the following equations and relationships:

$$Rb=ru+Ror+\alpha;$$

$$Ru=rb+Ror+\alpha;$$

ru<rb;

Ru>Rb; and $$\phi Pi-\phi Po=180^\circ(\phi Pi'-\phi Po'=180^\circ),$$

where:

Rb, ru, Ru, and rb are the radius for respective arcs;

Ror is the orbital radius of orbiting scroll 14;

$\alpha$ is a correction value, which avoids mutual interference between orbiting scroll 14 and fixed scroll 13;

$\phi$Pi ($\phi$Pi') is the widened-starting angle of the interior involute wall; and $\phi$Po ($\phi$Po') is the widened-starting angle of the exterior involute wall.

A surface between interior involute wall 14*d* of spiral element 14*a* and exterior involute wall 14*e* of spiral element 14*a* is a sealing surface. A surface between an edge comprised first upper arc Ru, second upper arc ru, and straight line Lu and an edge comprised first lower arc Rb, second lower arc rb, and straight line Lb may have no effect on compression mechanism and sealing mechanism, because it is not sealing surface.

Correction value $\alpha$ is adopted to avoid mutual interference between fixed scroll 13 and orbiting scroll 14 that are interfitted with each other during the manufacture of the scroll-type compressors. When correction value $\alpha$ equals x (an arbitrary assigned value), a space generated between fixed scroll 13 and orbiting scroll 14 at an orbit angle of orbiting scroll 14 in a range between upper, interior involute wall starting point Pi and upper, exterior involute wall starting point Po is continuously increased or decreased to within a range between 0 and 2x. A preferable numeral value of the arbitrary assigned value x is between about 0.050 mm and about 0.100 mm. A perspective view is shown in FIG. 3, when the space between fixed scroll 13 and orbiting scroll 14 equals 2x.

Figure 4:
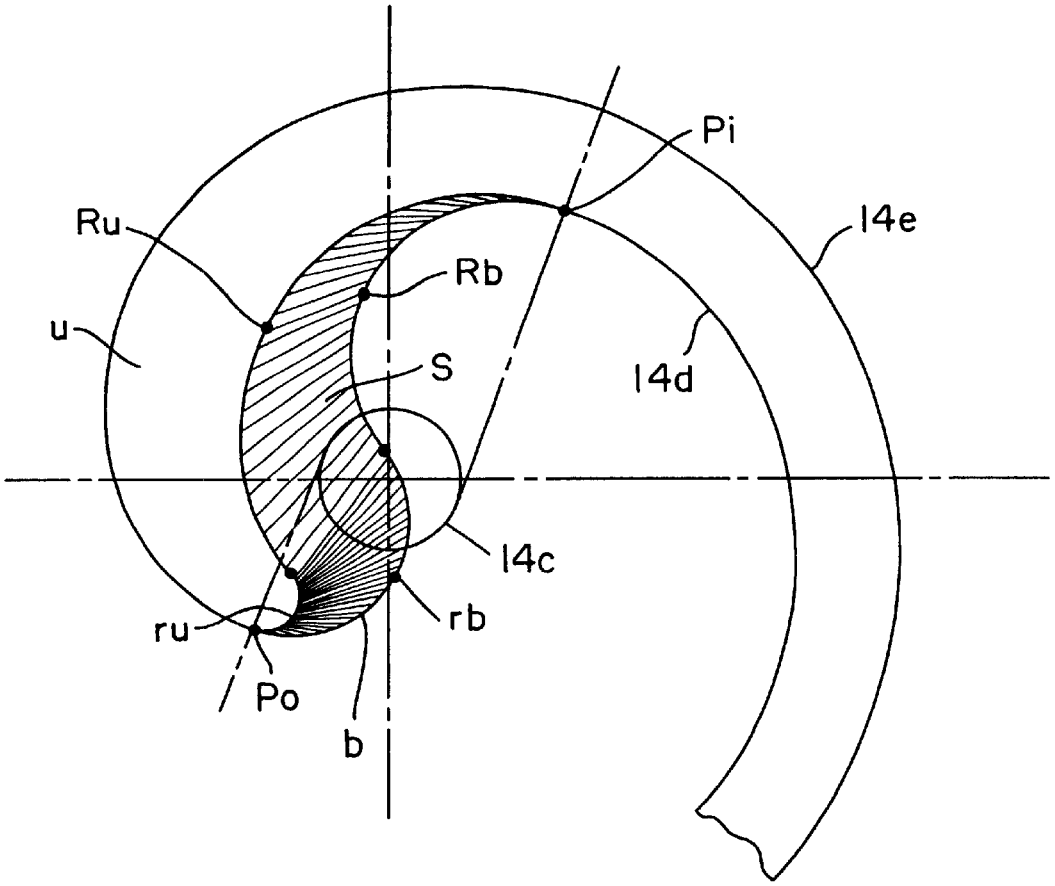
FIG. 4 is a plan view of the spiral element of the orbiting scroll of the scroll-type fluid displacement apparatus in accordance with another embodiment of the present invention.
Figure 5:
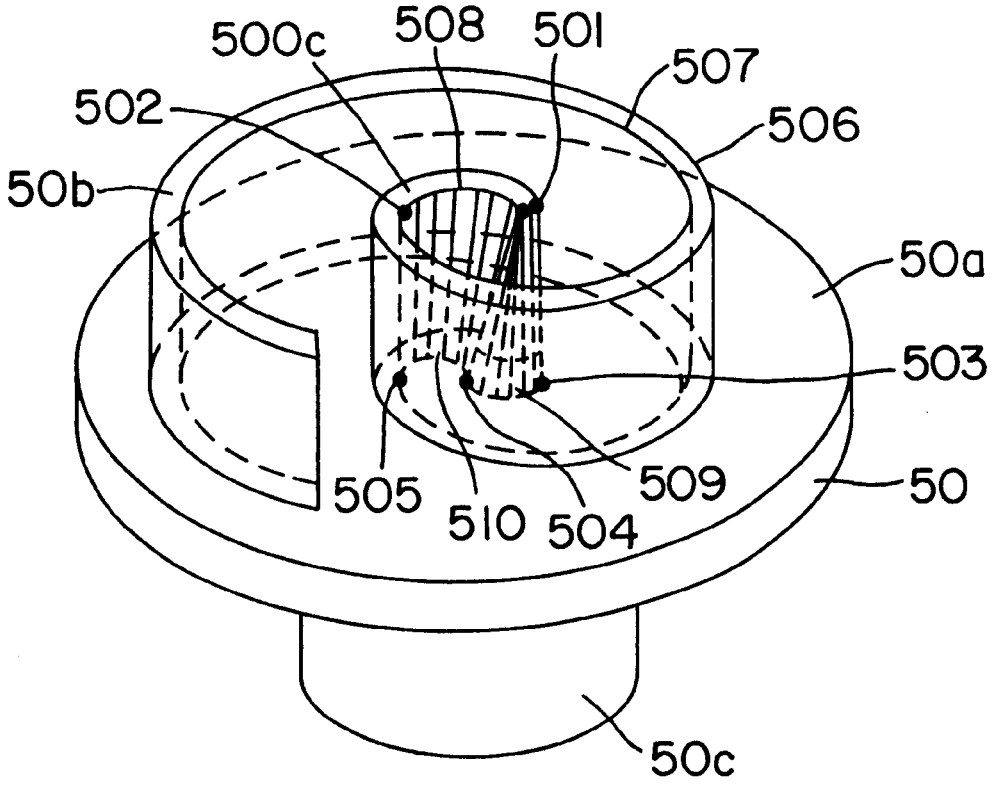
FIG. 5 (PRIOR ART)
FIG. 5 is a perspective view of an orbiting scroll of a known scroll-type fluid displacement apparatus.
Figure 6:
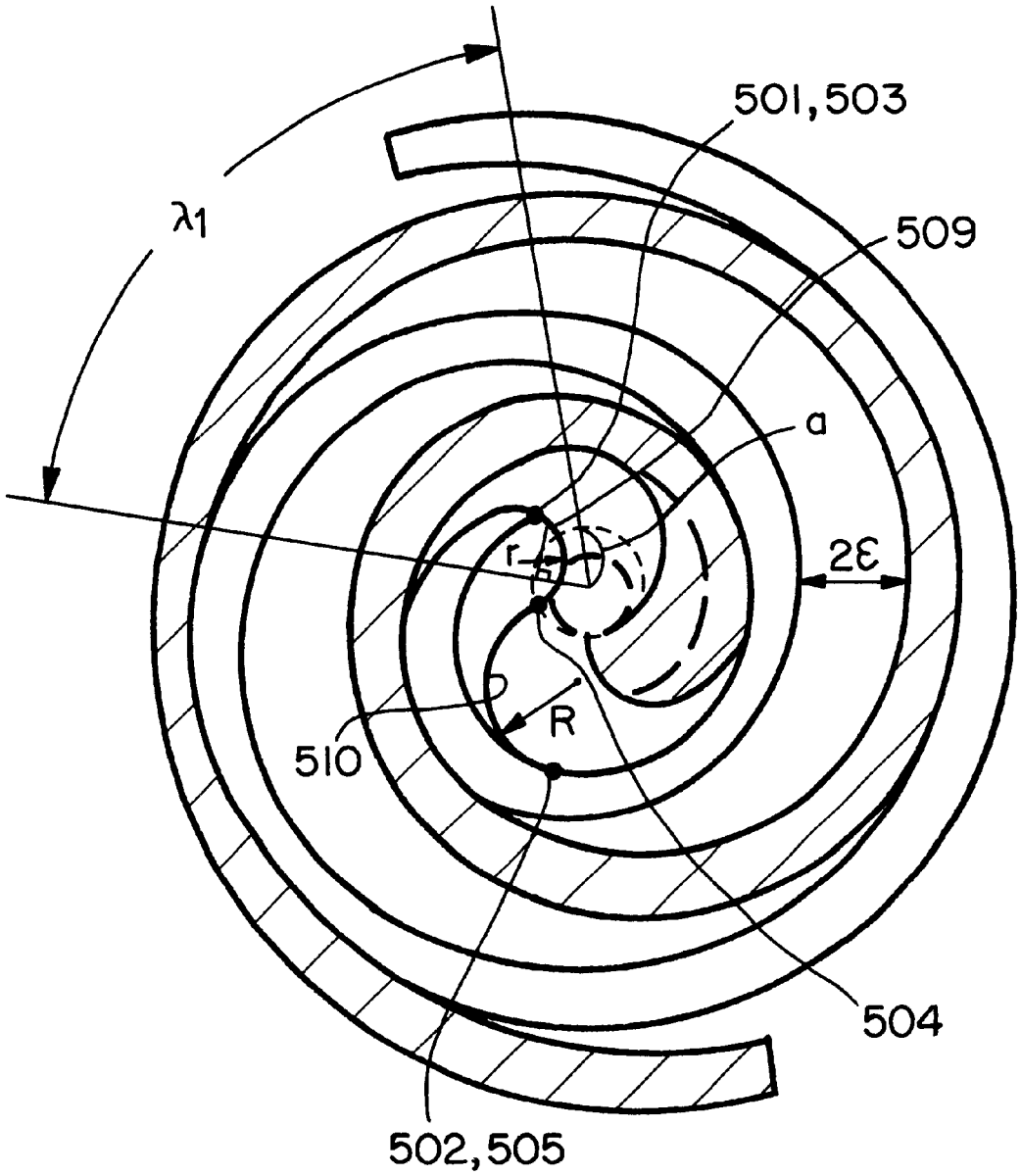
FIG. 6 (PRIOR ART)
FIG. 6 is a plan illustration of the compression and discharge strokes of a known scroll-type fluid displacement apparatus.
Figure 7A:
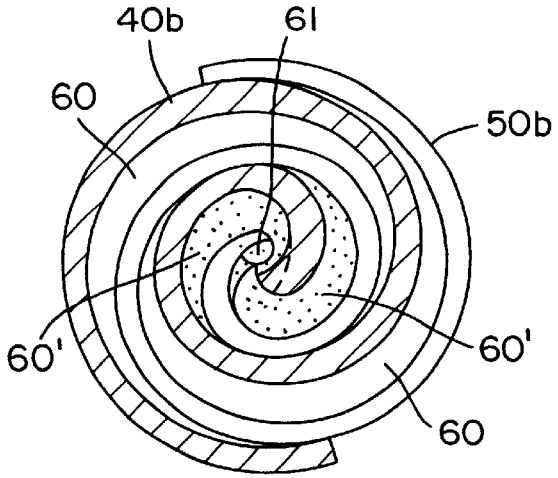
FIG. 7a (PRIOR ART)
FIGS. 7*a–d* are operational diagrams illustrative of the compression and discharge strokes of a known scroll-type fluid displacement apparatus.
Figure 7B:
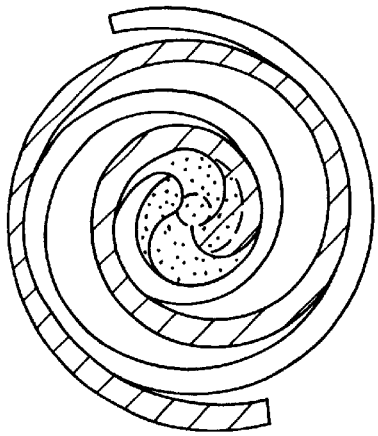
FIG. 7b (PRIOR ART)
Figure 7D:
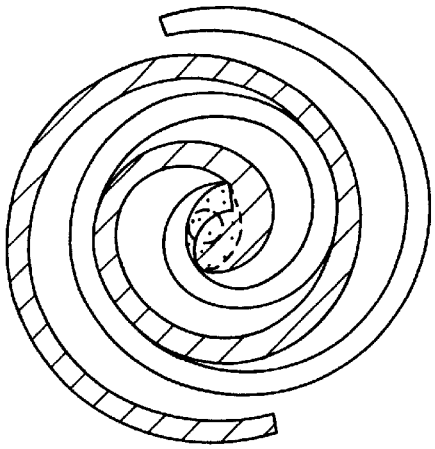
FIG. 7d (PRIOR ART)
Figure 7C:
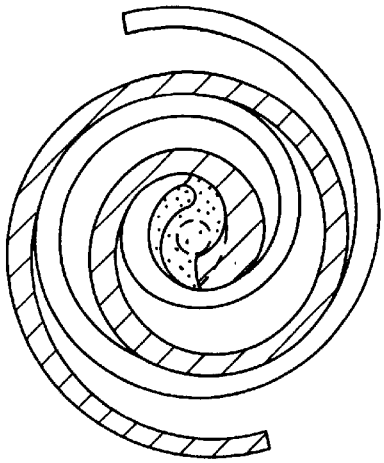
FIG. 7c (PRIOR ART)

Referring to FIG. 4, a second embodiment of the present invention is shown. If a circle 14*c* is the basic involute circle, a first transition line between interior wall s and tip surface u formed at the center of spiral element 14*a* comprises first upper arc Ru and second upper arc ru. First upper arc Ru is connected to interior involute wall 14*d* at upper, interior involute wall starting point Pi. Second upper arc ru is connected to exterior involute wall 14*e* at upper, exterior involute wall starting point Po. A second transition line between inside wall s and base surface b comprises first lower arc Rb and second lower arc rb. First lower arc Rb is connected to interior involute wall 14*d* at lower, interior involute wall starting point Pi'. Second lower arc rb is connected to exterior involute wall 14*e* at lower, exterior involute wall starting point Po'. In other words, in the orbiting scroll (and also the fixed scroll) of the second embodiment straight line portions Lu and Lb are removed from the orbiting scroll (and also the fixed scroll) of the first embodiment.

When correction value $\alpha$ equals 0 (an arbitrary assigned value), fixed scroll 13 and orbiting scroll 14 are operated to maintain their zero spacing without leakage of compressed gas and mutual interference, at every orbit angle of orbiting scroll 14. A dead volume of fixed scroll 13 and orbiting scroll 14 becomes zero, and both maximun compression efficiency and increased strength of spiral elements of both scrolls may be realized simultaneously.

As described above, with respect to embodiments of the present invention of a scroll-type fluid displacement apparatus, the strength of the central portions of spiral elements of fixed scroll 13 and orbiting scroll 14, the central portion of which receive an increased or the maximum load in high temperatures and high pressures when the scroll-type fluid displacement apparatus is operated, may be increased without sacrificing volmetric efficiency, e.g., compression efficiency, expansion efficiency, and discharge efficiency. Further, in a manufacturing of the scroll-type fluid displacement apparatus, correction value $\alpha$, which is a factor to determine configuration of spiral elements of fixed scroll 13 and orbiting scroll 14, may be set appropriately. As a result, fixed scroll 13 and orbiting scroll 14 may both obtain an increased or a maximum volmetric efficiency depending on machining accuracy.

Although the present invention has been described in connection with preferred embodiments, the invention is not limited thereto. It will be understood by those skilled in the art that variations and modifications may be made within the scope and spirit of this invention, as defined by the following claims.

What is claimed is:

1. A scroll-type fluid displacement apparatus comprising;

a rear housing having an open end and an inlet port and outlet port;

a front housing closing said open end;

a fixed scroll having a first end plate and a spiral element formed on and extending from a first side of said first end plate, and attached to said rear housing;

an orbiting scroll, having a second end plate and a spiral element formed on and extending from said first side of said second end plate, each of said spiral elements interfitting with the other at an angular and a radial offset to form a plurality of line contacts defining at least one pair of sealed-off fluid pockets;

a driving mechanism including a drive shaft rotatably supported by said front housing to effect an orbital motion of said orbiting scroll member by rotation of said drive shaft to thereby change a volume of said fluid pockets; and a rotation preventing mechanism means preventing said orbiting scroll from rotating;

wherein an interior wall of a widened-starting portion of each of said spiral elements is inclined, such that a thickness of a base surface of said widened-starting portion is greater than a thickness at a tip surface and the thickness of said widened-starting portion gradually decreases towards said tip surface of said widened-starting portion, and wherein a first transition line between said interior wall and said tip surface comprises a first upper arc connecting to an upper interior involute wall starting point and second upper arc connecting to an upper exterior involute wall starting point, wherein a second transition line between said interior wall and said base surface comprises a first lower arc connecting to a lower interior involute wall starting point and a second lower arc connecting to a lower exterior involute wall starting point, and wherein each of said elements is defined by the following equations and relationships:

$$Rb=ru+Ror;$$

$$Ru=rb+Ror;$$

ru<rb;

Ru>Rb; and $$\phi Pi-\phi Po=180°,$$

where:

Rb is a radius of the first lower arc;

rb is a radius of the second lower arc;

Ru is a radius of the first upper arc;

ru is a radius of the second upper arc;

Ror is an orbital radius of said orbiting scroll;

ϕPi is a widened-starting angle of an interior involute wall; and

ϕPo is a widened-starting angle of an exterior involute wall.

2. The scroll-type fluid displacement apparatus of claim 1, wherein a straight line connects between said first upper arc and said second upper arc, and wherein a straight line connects between said first lower arc and said second lower arc, and wherein a correction value avoids mutual interference between said fixed scroll and said orbiting scroll, and wherein said first lower arc and said first upper arc are defined by the following equations:

$$Rb=ru+Ror+\alpha;$$

$$Ru=rb+Ror+\alpha,$$

where:

α is the correction value.

* * * * *